United States Patent [19]

Gongwer

[11] Patent Number: 4,672,807

[45] Date of Patent: Jun. 16, 1987

[54] WALL THRUSTER AND METHOD OF OPERATION

[75] Inventor: Calvin A. Gongwer, Glendora, Calif.

[73] Assignee: Innerspace Corporation, Glendora, Calif.

[21] Appl. No.: 752,232

[22] Filed: Jul. 2, 1985

Related U.S. Application Data

[63] Continuation of Ser. No. 519,930, Aug. 3, 1983, abandoned.

[51] Int. Cl.[4] ..... B63H 11/08; B63H 25/46

[52] U.S. Cl. ..... 60/222; 114/151; 440/38

[58] Field of Search ..... 60/221, 222, 229; 114/151, 148; 440/38, 40, 41, 47

[56] References Cited

U.S. PATENT DOCUMENTS

| | | | |
|---|---|---|---|
| 1,484,881 | 2/1924 | Gill | 60/222 |
| 3,590,766 | 7/1971 | Jackson | 114/151 |
| 3,809,005 | 5/1974 | Rodler | 114/151 |
| 3,835,806 | 9/1974 | Rice | 114/151 |
| 4,073,257 | 2/1978 | Rodler | 60/221 |
| 4,278,431 | 7/1981 | Krautkremer | 114/151 |

*Primary Examiner*—Louis J. Casaregola
*Attorney, Agent, or Firm*—Lyon & Lyon

[57] ABSTRACT

A wall thruster for surface or submarine vessels that is cavitation resistant and does not require a hull duct. The invention comprises an impeller mounted in a swirl chamber such that seawater is rotated under pressure. The water is then discharged through streamlined nozzles in a direction to minimize mixing with the flow of the water being drawn into the impeller.

5 Claims, 4 Drawing Figures

WALL THRUSTER AND METHOD OF OPERATION

This is a continuation of application Ser. No. 519,930, filed Aug. 3, 1983, now abandoned.

BACKGROUND OF THE INVENTION

1. Field of the Invention

The field of the invention is marine thrusters. More specifically, the present invention is directed to a marine thruster that is cavitation resistant and does not require a duct through the hull of the marine vessel to which it is attached.

2. Description of the Prior Art

The prior art includes my U.S. Pat. No. 4,055,947, Hydraulic Thruster, granted Nov. 1, 1977 and my U.S. Pat. Nos. 4,137,709 and 4,213,736, both titled Turbomachinery and Method of Operation, granted Feb. 6, 1979 and July 22, 1980, respectively, which are incorporated herein by reference. The basic design relationship for turbo-machinery is defined by the Euler turbine equation, a form of Newton's laws of motion applied to fluid traversing a rotor, see generally, Shepard, Principles of Turbomachinery, Energy Transfer Between a Fluid and a Rotor (Macmillian Co. 1965).

Most of the marine thrusters presently used on ships and barges require internal ducting through the bow of the ship. These hull ducts are expensive, inconvenient and inefficient. One of the drawbacks with these ducts is that large scooped ports must be made on the side of the ship for the thruster to operate properly. These large ports create tremendous drag as the ship travels through the water. The extra drag has currently become a concern among shipbuilders and users as a result of the high cost of fuels.

The propellers currently used in the ducted thrusters are generally birotational and are prone to cavitation when driven at high thrust levels. The cavitation, besides creating a noise nuisance, is damaging to parts and limits the maximum thrust level, resulting in inefficient operation. Further, as these thrusters are bidirectional, screening is desirable on the intake/outflow ports. The fixed screens on the ports further reduce the maximum thrust.

As the use of the ducted thrusters require a duct from one side of the hull to the other, certain vessels are unable to employ these thrusters. On some vessels it is either too expensive to install the lengthy duct necessary or the length of the duct will require too large a thruster to overcome frictional losses and still achieve adequate thrust. Further, on barges and cargo carriers the duct takes up precious space that would otherwise be used for cargo.

As such, although thrusters are presently available they are extremely inefficient as a result of the drag from the ports, the cavitation of the impellers, losses due to screens and losses due to the length of the duct.

SUMMARY OF THE PRESENT INVENTION

The present invention pertains to marine thrusters. More specifically, a marine thruster that does not require a duct through the hull of a ship or barge and is cavitation resistant.

The wall thruster disclosed herein is capable of being mounted in the hull of a ship or barge such that the intake port and discharge nozzles are relatively small in cross-sectional area and are flush with the hull of the ship. This type of construction results in a minimum amount of drag as the ship moves through the water.

The wall thruster is replete with advantages. As there is no need for a hull duct with the wall thruster this device is ideal for flat bottom barges and cargo ships which previously could not utilize side thrusters. As the wall thruster impeller is unidirectional, the impeller may be of the mixed-flow type avoiding problems of cavitation at high thrust levels. Further, since it is unidirectional there are no screens on the discharge nozzles. This lack of discharge screens eliminates losses in thrust due to resistance caused by the screens. The intake port is surrounded by discharge nozzles creating high velocity rods of water which act as a screening device for the intake port preventing seaweed and fishnets from fouling the intake screen. These features combine to provide an energy-efficient side thruster and propulsion system.

Accordingly, a wall thruster, is disclosed that is cavitation resistant and does not require a duct through the hull of a ship or barge. Other and further objects of the invention will appear hereinafter.

DETAILED DESCRIPTION OF THE PREFERRED EMBODIMENT

Figure 1:
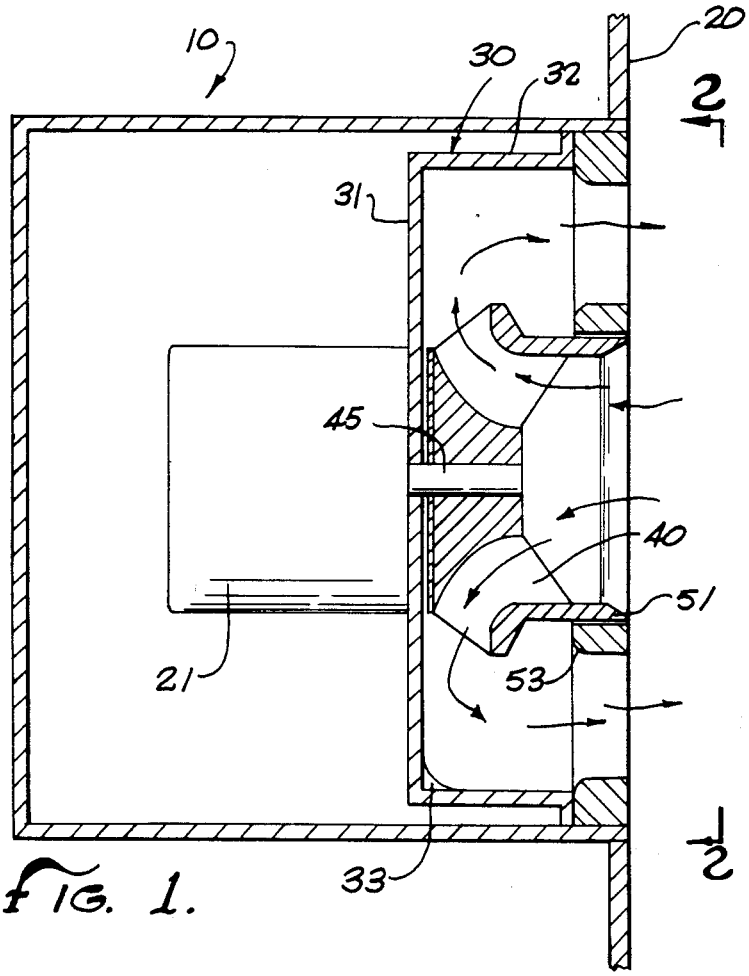
FIG. 1 is a cross-sectional view of the wall thruster shown mounted in the hull of a ship.

FIG. 1 shows a wall thruster mounted inside a sea chest 10 such that the wall thruster is flush with the hull of a ship or barge 20. While FIG. 1 shows the driving means 21, submerged inside a seachest 10, if desired, the driving means 21 may be mounted inside a cargo bay in the hull of a ship. The method of mounting is determined solely by the vessel and manner in which the thruster is used, and should be such that accessibility for maintenance is the easiest.

The wall thruster consists of a swirl chamber, generally designated 30, which is comprised of a backplate 31 and a cylinder 32. The backplate 31 and the cylinder 32 are attached in such a manner that a water tight chamber is created, which allows the fluid inside that chamber to rotate in an unrestricted manner. If desired the inside of the point of connection between the cylinder 32 and the backplate 31 may be filleted 33 to provide a continuous inner surface.

The driving means 21 is connected to the impeller 40 by a rotatable shaft 45. The shaft 45 is rotably mounted to the backplate 31. The impeller 40 is installed with minimum clearance between the backplate 31 and the impeller 40. The mounting is typical of what one would find in a normal centrifugal pump. The impeller 40 is of the mixed-flow type, equivalent to those used in multistage propeller pumps and is virtually cavitation free at high powers.

Figure 2:
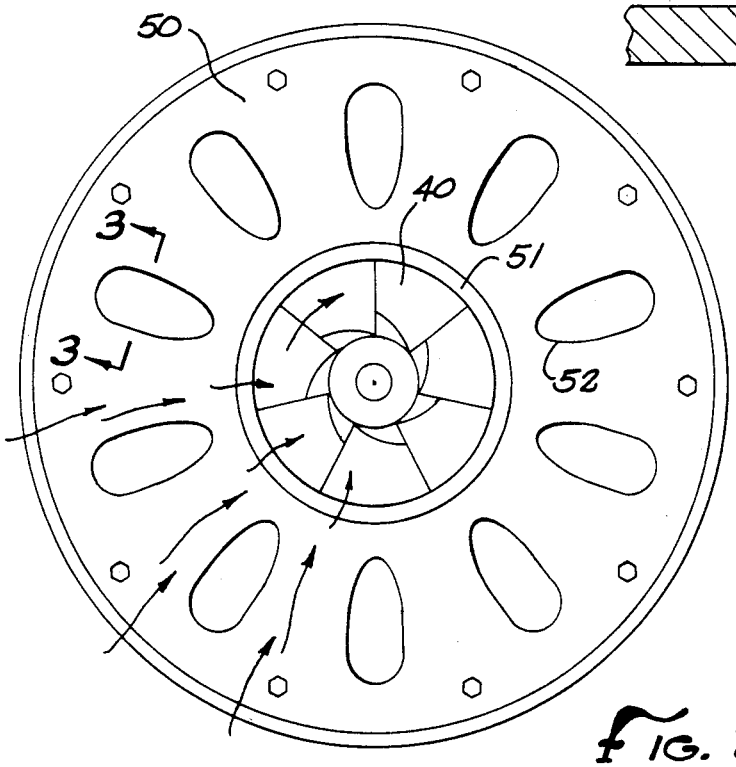
FIG. 2 is a view taken along the plane 2—2 of FIG. 1.

A nozzle plate 50 is removably attached to the cylinder 32. The nozzle plate 50 is mounted such that the intake port 51 is concentric with the eye of the impeller 40. The intake port 51 is surrounded by a concentric ring of nozzles 52. Both the intake port 51 and the nozzles 52 are flush with the outer surface of the nozzle plate 50. FIG. 2 shows the nozzle plate 50 having ten nozzles 52. The actual number of nozzles required will depend upon the size of the wall thruster and the application in which the wall thruster is utilized.

Figure 3:
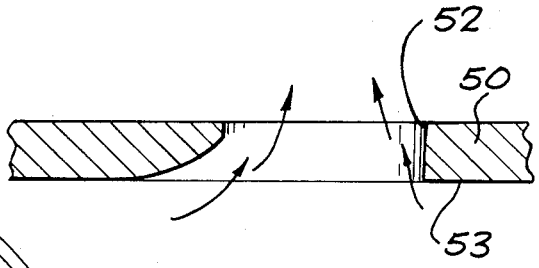
FIG. 3 is a view taken along the plane 3—3 of FIG. 2.

FIG. 3 is a cross-section of one of the nozzles 52. One edge of the nozzle 52 on the inner surface 53 is formed into an inclined bellmouth. The inclined bellmouth is on the edge of the nozzle 52 opposite the rotation of the impeller 40. The bellmouth shape allows for a smooth discharge of the rotating fluid from the swirl chamber 30. In certain applications the nozzles 52 may be angled outwardly from the center of the nozzle plate 50 creating a cone-shaped array of discharge jets rather than a cylindrical array.

As is shown in FIG. 2, the nozzles 52 are radially streamlined with reference to the nozzle plate 50. The streamlining of the nozzles 52 creates a converging-/diverging passageway for the inflowing seawater. This streamlining results in a more efficient thruster as less power is required to draw in the necessary seawater through the intake port 51. Also, the mixing between the exit jets and the intake water is reduced to a minimum.

Having fully described the wall thruster of this invention, it's method of operation will now be discussed. When the wall thruster is mounted flush with the hull of a ship or barge 20, the rotation of the impeller 40 will draw seawater is through intake port 51 and force it into the swirl chamber 30. As the seawater is forced into the swirl chamber 30 the rotation of the impeller 40 also imparts a rotational force, in the same direction as the impeller 40, to the seawater. Thus, the seawater rotates in the swirl chamber 30, at a pressure greater than ambient.

The pressurized rotating sea water in the swirl chamber 30 is forced through the nozzles 52. As a result of the inclined bellmouth edge of the nozzle 52, shown in FIG. 3, the discharge of the seawater from the swirl chamber 30 is relatively free from turbulence. The discharging seawater, as a result of the streamlined shape of the nozzle 52, is formed into a plurality of high velocity rods of water. The radial streamlining of the nozzles 52 facilitates the flow of the incoming seawater into the intake port 52. The converging/diverging aspect of this streamlining results in greater efficiency of the wall thruster. The discharging water not only provides thrust, but also acts as a builtin screen, preventing suction of foreign objects into the eye of the impeller.

Figure 4:
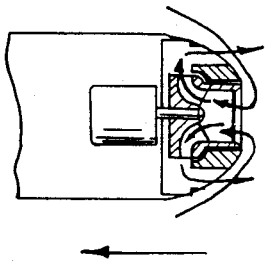
FIG. 4 is a drawing of the wall thruster used as a propulsion unit on a submerged vehicle.

FIG. 4 shows the wall thruster utilized as the main propulsion system for an underwater vehicle. The unique method of operation of this device results in a torqueless propulsion system for surface or submarine vehicles.

Having described this invention in its preferred embodiments in detail, it is understood that certain modifications may be made to the described invention by those skilled in the art without departing from the inventive concepts disclosed herein. As such the scope of the disclosed invention is not to be restricted or narrowed except to the extent of the appended claims.

What is claimed is:

1. A wall thruster comprising an impeller of the mixed-flow type;

a driving means for rotating said impeller;

a swirl chamber comprising a cylinder and a backplate, wherein said backplate is attached to a first end of said cylinder and said impeller is rotatably mounted to said backplate coaxially with the axis of said cylinder;

a nozzle plate removably attached to a second end of said cylinder, the plane of said nozzle plate being substantially perpendicular to the axis of said cylinder, said nozzle plate comprising an intake port located in the center of said nozzle plate, and having a plurality of nozzles defined in said nozzle plate located around said intake port in the same plane, wherein the sides of said nozzles are substantially parallel to the centerline of said intake port, the outermost portion of said intake port and said nozzles being essentially flush with the outermost surface of said nozzle plate.

2. A wall thruster comprising an impeller a driving means for rotating said impeller;

a swirl chamber comprising a cylinder and a backplate, wherein said backplate is attached to a first end of said cylinder and said impeller is rotatably mounted to said backplate coaxially with the axis of said cylinder;

a nozzle plate removably attached to a second end of said cylinder, the plane of said nozzle plate being substantially perpendicular to the axis of said cylinder, said nozzle plate comprising an intake port located in the center of said nozzle plate, and having a plurality of nozzles defined in said nozzle plate and located around said intake port, the outermost portion of said intake port and said nozzles being essentially flush with the outermost surface of said nozzle plate and having a substantially elliptical cross section, the major axes of the ellipses projecting radially with respect to the center of said nozzle plate defining a converging passageway between said nozzles.

3. A wall thruster comprising an impeller a driving means for rotating said impeller;

a swirl chamber comprising a cylinder and a backplate, wherein said backplate is attached to a first end of said cylinder and said impeller is rotatably mounted to said backplate coaxially with the axis of said cylinder;

a nozzle plate removably attached to a second end of said cylinder, the plane of said nozzle plate being substantially perpendicular to the axis of said cylinder, said nozzle plate comprising an intake port located in the center of said nozzle plate, and having a plurality of nozzles defined in said nozzle plate and located around said intake port, the outermost portion of said intake port and said nozzles being essentially flush with the outermost surface of said nozzle plate wherein said nozzle plate has an interior surface and the portions of said interior surface which are contiguous with the portions of said nozzles which are located radially outwardly with respect to the center of said nozzle plate have a tapered edge, said portions of said interior surface are in the shape of an inclined bellmouth.

4. A wall thruster comprising an impeller of the mixed-flow type;

a means for rotating said impeller;

a swirl chamber comprising a cylinder and a backplate, wherein said backplate is attached to a first end of said cylinder and said impeller is rotatably mounted to said backplate coaxially with the axis of said cylinder;

an intake port located at the opposite end of said cylinder directly communicating with said swirl chamber and at least two outlet nozzles located at said opposite end around said intake port in a circular array, the outermost portions of said intake port and said outlet nozzles being essentially flush with the outermost surface of the said opposite end of said cylinder, said nozzles having a substantially elliptical cross-section, the major axis of the ellipses projecting radially with respect to the circular array of outlet nozzles.

5. A wall thruster comprising an impeller of the mixed-flow type;

a means for rotating said impeller;

a swirl chamber comprising a cylinder, a backplate and a nozzle plate, said backplate being attached to a first end of said cylinder, said nozzle plate being attached to an opposite end of said cylinder including an intake port the outermost portion of which is essentially flush with the outer surface of the nozzle plate, and directly communicating with said swirl chamber, said impeller being rotatably mounted to said backplate in said swirl chamber coaxially with the axis of said cylinder and such that the eye of said impeller is aligned with said intake port;

at least two outlet nozzles defined in said nozzle plate and located around said intake port in a circular array, the outermost portions of said outlet nozzles being essentially flush with the outermost surface of said nozzle plate;

said nozzles having a substantially elliptical cross-section, the major axis of the ellipses projecting radially with respect to the circular array of outlet nozzles;

said nozzle plate further comprises an interior surface, the portions of said interior surface which are contiguous with the portions of said nozzles which are located radially outwardly with respect to the center of said nozzle plate have a tapered edge such that said nozzles have a cross-section with one edge having the shape of an inclined bellmouth.

* * * * *